US008613875B2

(12) United States Patent
Schuecker

(10) Patent No.: US 8,613,875 B2
(45) Date of Patent: Dec. 24, 2013

(54) METHOD AND DEVICE FOR THE SUCCESSIVE PRODUCTION OF COAL BRIQUETTES COMPATIBLE WITH A COKE CHAMBER

(75) Inventor: Franz-Josef Schuecker, Castrop-Rauxel (DE)

(73) Assignee: Thyssenkrupp Uhde Gmbh, Dortmund (DE)

( * ) Notice: Subject to any disclaimer, the term of this patent is extended or adjusted under 35 U.S.C. 154(b) by 0 days.

(21) Appl. No.: 13/508,355

(22) PCT Filed: Oct. 30, 2010

(86) PCT No.: PCT/EP2010/006634

§ 371 (c)(1),
(2), (4) Date: May 5, 2012

(87) PCT Pub. No.: WO2011/057721

PCT Pub. Date: May 19, 2011

(65) Prior Publication Data

US 2012/0216454 A1 Aug. 30, 2012

(30) Foreign Application Priority Data

Nov. 13, 2009 (DE) ..... 10 2009 052 901

(51) Int. Cl.
*C10L 5/06* (2006.01)
*B29C 43/04* (2006.01)

(52) U.S. Cl.
USPC ..... 264/109; 44/596; 44/636; 425/253; 425/452; 264/120

(58) Field of Classification Search
None
See application file for complete search history.

(56) References Cited

U.S. PATENT DOCUMENTS 3,008,199 A 11/1961 Jeppesen
3,284,372 A 11/1966 Bailey (Continued)

FOREIGN PATENT DOCUMENTS

DE 542139 C 1/1932
DE 227178 8/1932

(Continued)

OTHER PUBLICATIONS

International Search Report for PCT/EP2010/006634. English translation attached to original. Both completed by the European Patent Office on May 3, 2011. All together 5 Pages.

(Continued)

*Primary Examiner* — Mary F Theisen
(74) *Attorney, Agent, or Firm* — Brooks Kushman P.C.

(57) ABSTRACT

A method for production of coke chamber-compatible coal briquettes. Horizontally feeding coal into a pressing mold formed from a plate having two parallel terminating walls, which are stationary with respect to the direction of movement of the plate, and a terminating stop wall disposed transversely to the direction of movement of the plate. The side of the pressing mold open to coal is closed by a stationary wall, and the plate is locked in the horizontal direction for the pressing operation. The coal is compacted by a tamping device, having a vertically acting force onto pressing mold to produce a coal briquette. After completion of the coal briquette, the plate is moved horizontally in the longitudinal direction so that the space in the pressing mold becoming free in the horizontal direction is used for producing the next coal briquette. A device for carrying out the method is also disclosed.

14 Claims, 5 Drawing Sheets

(56) References Cited

U.S. PATENT DOCUMENTS

Figure 1:
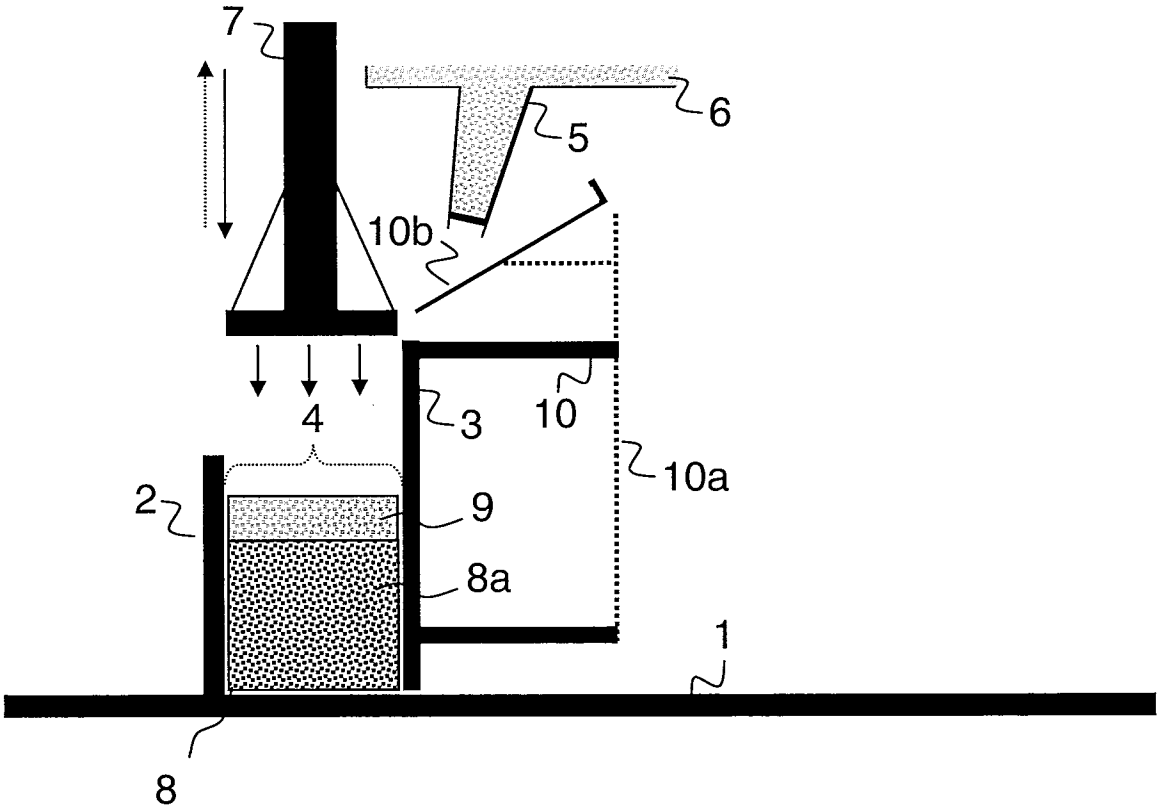

| | | | | |
|---|---|---|---|---|
| 3,912,091 | A | 10/1975 | Thompson | |
| 4,123,216 | A * | 10/1978 | Leibrock | 425/431 |
| 4,606,876 | A * | 8/1986 | Yoshida et al. | 264/120 |
| 6,290,494 | B1 | 9/2001 | Barkdoll | |
| 6,332,957 | B1 | 12/2001 | Gross et al. | |
| 7,147,452 | B2 | 12/2006 | Everett et al. | |
| 7,311,865 | B2 | 12/2007 | Williamson | |
| 7,815,829 | B2 | 10/2010 | Schuecker | |
| 2009/0321980 | A1 * | 12/2009 | Fiedler et al. | 264/120 |

FOREIGN PATENT DOCUMENTS

| | | | |
|---|---|---|---|
| DE | 2922861 | A1 | 12/1980 |
| DE | 3145344 | | 5/1983 |
| DE | 3236967 | | 4/1984 |
| DE | 3533071 | | 3/1987 |
| DE | 3910214 | | 5/1990 |
| DE | 19545736 | A1 | 6/1997 |
| DE | 19803455 | | 8/1999 |
| DE | 19807484 | | 9/1999 |
| JP | 57090090 | A | 6/1982 |
| JP | 59122581 | | 7/1984 |
| SU | 1784628 | | 12/1992 |
| WO | 0229345 | A1 | 4/2002 |
| WO | 2006056286 | A1 | 6/2006 |

OTHER PUBLICATIONS

International Search Report for PCT/EP2010/006634, English translation attached to original, Both completed by the European Patent Office on May 3, 2011, All together 5 Pages.

* cited by examiner

METHOD AND DEVICE FOR THE SUCCESSIVE PRODUCTION OF COAL BRIQUETTES COMPATIBLE WITH A COKE CHAMBER

CROSS-REFERENCE TO RELATED APPLICATION

This application is the U.S. national phase of PCT Appln. No. PCT/EP2010/006634 filed on Oct. 30, 2010, which claims priority to DE Patent Application No. 10 2009 052 901.2 filed on Nov. 13, 2009, the disclosures of which are incorporated in their entirety by reference herein.

The invention relates to a method for horizontally successive production of coal pressing blocks suitable for coke oven chambers, wherein the coal is pressed in a press mould by vertical repeated stamping and wherein the shaping is accomplished by horizontal pressing to walls impermeable to coal, with one wall being mounted on a plate which is braked, and with two walls being movably supported in horizontal direction perpendicular to the plate, and wherein the production of coal blocks is accomplished successively by way of shifting the plate horizontally against a stationary wall. The invention also relates to a device by way of which these coal pressing blocks can be produced.

In numerous construction types, the charging of coke oven chambers is accomplished horizontally through a coke oven chamber door. Coal carbonization is frequently confronted with a problem in that the coal cannot be provided in precisely measured portions. It is also tried to find a possibility for charging the coal in the most compact manner possible and without any voids into the coke oven chambers in order to optimize the quantity of carbonized coal for cokemaking For this reason, there are prior art methods and processes available by way of which coal is pressed or compacted so that the coal is provided in form of finish-pressed blocks that are precisely dimensioned in terms of their quantity. Nevertheless the blocks composed of coal shall permit a gas evolution of coking gases.

DE 19545736 A1 describes a method for charging a coke oven which is floor-heated and which is provided with a low charging height and a large oven sole surface. According to this construction type, coal is charged horizontally into the coke oven chamber, with said coal according to the invention being poured outside the oven at an even level onto a planar bottom plate and subsequently compacted to obtain a compacted coal cake which is gently pushed into the coke oven chamber, retracting the bottom plate subsequently from the coke oven chamber whilst the coal cake is retained at the front side. The coke oven chamber is thus charged with a compacted coal cake. The method does not disclose any hints relating to several pressed blocks that are produced simultaneously so as to allow for gas evolution of coking gases between the pressed blocks.

WO 2006056286 A1 describes a hydraulic pressing device for producing a compacted coal cake composed of a pourable bulk coal material for use in a coke oven, said device being comprised of a press mould formed by a car or sled comprising walls, a floor and a stop wall and above which a feeding chute for coal is arranged transversely to its direction of travel, and comprising a cylinder headpiece which presses the bulk coal material supplied from the feeder chute by means of a hydraulic device horizontally against the arrest wall so that the pourable bulk coal material obtained from the coal can be pressed by a multitude of horizontal pressing cycles to a density that is by up to 60% higher. The upper limit of the coal cake is set by a pressed cake cover. A pressing force acting vertically and several times onto the coal cake for compaction is not described therein.

DE 2922861 A describes a method for compaction of a fine-grain coal blend destined for coal carbonization, said coal blend being flung by a feeder system into a compacting mould, which is accomplished by one or several fling wheels which are equipped with one or several blades. Compaction by way of the blade arrangement is executed in bales and performed by means of the kinetic energy which is taken-up by spinning-off the coal particles into the compacting mould provided for this purpose. This method depends on the quality of the implemented coal and it may require certain residual moisture, preheating or the addition of an appropriate bonding agent.

WO 0229345 A1 describes a method for charging a coke oven chamber with coal, wherein a combined charging and pushing machine is arranged beside the coke oven chamber door, said machine also performing the compaction of coal, and wherein the compaction is effected in a compartment that is formed by two movable side walls and two stationary side walls, and wherein the coal cake thus compacted is loaded after compaction into the coke oven chamber. A pressing force acting vertically is not provided for here either. And it is not possible either to subdivide the compacted coal cake into several single pressed green compacts so as to achieve an improved gas evolution during coal carbonization.

It would be a substantial advantage to provide a method and process that compacts the coal with a vertically acting load and by way of which pressed green compacts containing voids are obtained from the loose coal so that the coking gases evolving on coal carbonization can escape. It would also be of advantage to have the possibility to charge the coal directly from the compacting unit into the coke oven chamber.

The present invention solves this task by providing a method that produces coal pressing blocks from pourable bulk coal which are suitable for use in coke oven chambers, and according to which the coal is compacted by a vertically acting force, thus furnishing the coal in portions so that voids still remain between these portions through which the coking gas evolving on coal carbonization can escape, with the horizontal press mould being formed by walls impermeable to coal, thereof one wall being mounted on a plate in a preferably back-foldable arrangement, and another two walls thereof being mounted laterally and uni-dimensionally in a stationary arrangement, and another stationary wall being pressed against the plate during the compacting procedure, and wherein the vertically acting force is exerted by a horizontally stationary stamping device so that the coal compacts can be successively produced by a horizontal movement of the plate.

Claim is laid in particular to a method for successive production of coal pressing blocks suitable for use in coke oven chambers, wherein

- the coal is poured from a coal feeder device into a press mould comprised of a movable plate equipped with a back-foldable stop wall impermeable to coal, and comprised of two laterally displaceable walls impermeable to coal which can be moved perpendicular to the direction of movement of the plate in the other horizontal direction into the desired position so that the press mould is permeable to coal only in one horizontal direction, and
- the side of the press mould which is permeable to coal is closed by a stationary closure wall during the production of coal pressing blocks and moved towards the plate so that the coal is retained by the press mould in the horizontal shape so as to obtain a coal pressing block on pressing, and wherein the plate is moved horizontally in the longitudinal direction of the press mould upon completion of a coal pressing block, and wherein the plate can continue to be transversely displaceable in horizontal direction, and which is characterized in that for the pressing procedure the plate is braked or arrested in horizontal direction or moved against the stationary closure wall, and the coal is compacted by a stamping device pressed by a device with a vertically acting force onto the coal in the press mould, with the coal being retained by the press mould in the horizontal shape so as to obtain a coal pressing block, and wherein the space in the press mould exposed in horizontal direction as the plate is moved on is utilized for the production of the next coal pressing block.

The plate with the back-foldable closure wall, which is impermeable to coal and rigidly mounted to the plate, serves as a car due to the horizontal mobility of the plate. By the existence of the back-foldable coal-impermeable closure wall at the plate and the two stationary walls extending in parallel to the direction of movement of the plate in one horizontal direction which are movable vertically to the direction of movement of the plate in the second horizontal direction, it is possible to retain the coal pressing blocks even during another stamping procedure in the mould and to avoid a spreading of coal in horizontal direction. Accordingly, the plate is moved into a position in which the two lateral walls can be moved towards the plate in an appropriate position so that a press mould with the desired lateral pressure is obtained. The coal-permeable side thus formed is closed by the coal-impermeable stationary stop wall against which the plate is moved or braked for pressing.

The method is advantageously so configured that the produced coal pressing blocks are covered during the production of the next coal pressing block by way of a cover plate arranged above the coal pressing block. Thereby it is possible to retain the coal pressing blocks in the mould even during another stamping procedure and to avoid a spreading of coal in upward direction.

The plate is advantageously supported on rollers so that the plate is horizontally movable in a uni-dimensional manner. The rollers proper are supported on a car which is movable in the second horizontal direction so that the car is moved for charging in one direction to the front of the coke oven chamber destined for charging, and so that the plate is moved in the other direction to the coke oven chamber destined for charging. In one embodiment of the present invention, the plate is moved with the coal pressing blocks for charging into the coke oven chamber and after charging it is refracted again from the coke oven chamber, holding the coal cake tight at the front side.

In another embodiment of the inventive method, it is also possible to remove, fold back or sink the arrest wall mounted at the car, with the car being moved close to the opened coke oven chamber, sliding the coal cake composed of finish-coal pressing blocks for charging the coke oven chamber from the car into the coke oven chamber. Thereby, the coal pressing blocks can be loaded directly from the car into the coke oven chamber. The inventive method is intended to enable charging of a single coal pressing block as well as part of the coal pressing blocks as well as all coal pressing blocks into the coke oven chamber.

A coal pressing block produced by applying the inventive method typically has an average width of 3500 mm to 4500 mm and an average length of 450 mm to 550 mm. In a preferred embodiment, the coal pressing blocks have an average width of 3750 mm and an average length of 500 mm. However, the method can be altered so that the coal pressing blocks have any arbitrary dimension.

In a typical embodiment, the coal pressing block(s) has (have) an average height of 950 mm to 1050 mm after production. In a preferred embodiment, the height of the coal pressing blocks after production accounts for 1000 mm on average.

Claim is also laid to a device by way of which the inventive method can be implemented.

Claim is laid in particular to a device for horizontally successive production of coal pressing blocks suitable for use in coke oven chambers, said device comprised of one horizontally supported plate movable in one direction, two stationary coal-impermeable closure walls extending in parallel to the horizontal direction of movement of the plate and vertically movable to the direction of movement of the plate, one coal-impermeable closing arrest wall mounted on the plate and arranged transversely to the direction of movement of the plate so that the plate with the two lateral walls and the arrest wall form a press mould which is impermeable to coal in three horizontal directions, and wherein a coal feeder device is arranged above the press mould through which the plate acting as press mould can be filled with pourable bulk coal, and wherein the plate can also be horizontally movable via suitable devices transversely to the direction of movement, which is characterized in that the plate with the coal-permeable side of the press mould can be moved with a device against a stationary coal-impermeable closure wall or can be braked in front of the stationary coal-impermeable closure wall in a position destined for a pressing cycle, and wherein a stationary stamping device is arranged above the plate, said stamping device being movable in vertical direction and equipped with appropriate lifting mechanisms and exerting a pressing weight load onto the coal lying beneath when falling onto the coal.

The stamping device which is movable in vertical direction and utilized for stamping the coal is preferably driven by a hydraulic device. However, it is also feasible to utilize an electrically or mechanically operated device. The stamping device may be of any design and/or construction type. In a typical embodiment, the coal-feeding device is a reciprocating plate feeder. It typically supplies pourable bulk coal from a coal reservoir bin. However, other construction types are feasible in connection with the main claim of the said device in any embodiment.

For executing the present invention, the plate is horizontally uni-dimensional or nearly uni-dimensionally movable depending on the lateral guidance. Upon production of a press mould, it is constantly moved on a bit so that the stamping device is positioned above the coal mould to be compacted. In addition to the uni-dimensional horizontal mobility, the plate may be supported on rollers which are mounted on a car that can be moved transversely to it in horizontal direction along the front of the coke oven battery. To provide support, the bearing rollers for the compacting station may be installed in a stationary arrangement.

In a possible embodiment, this car is equipped with wheels to allow for its movement. In another embodiment, the plate is equipped with skids to allow for its movement, and these skids can be moved on rails destined for this purpose so that the plate can be designated as a sled. The plate can then be moved along the front of the coke ovens. Drives or arresting devices can be provided at any arbitrary position.

The invention provides a method and a device that compact the coal with a vertically acting force so that press moulds containing voids are developed from the loose coal. Thereby, the coking gases evolving on coal carbonization can escape. Coal can be charged directly from the compacting facility into the coke oven chamber. Expenditure on plant equipment and technology can thus be saved.

The inventive device is elucidated by way of five drawings which represent a temporal sequence of a typical pressing cycle. These drawings just represent an exemplary embodiment for the design and construction of the inventive method, which is not restricted to the form of this embodiment.

FIG. 1 shows the inventive plate (1) with an arrest wall (2) fastened on it. Not to be seen here are the two lateral walls which are arranged in parallel to the plane of the drawing paper. During the pressing cycle, the plate (1) is moved against a stationary closure wall (3), thus forming the press mould (4). Pourable bulk coal (6) is filled via the coal feeder device (5) into the press mould. The stamping device (7) then presses the coal (6) into compacted coal pressing blocks (8). To be seen here, too, is the loose coal layer (9) still lying on there which is pressed from the coal feeder device (5) onto the already compacted coal pressing block (8*a*). The closure wall (3) is comprised of a cover plate (10), which is equipped with a holding device (10*a*) for the feeder plate (10*b*).

Figure 2:
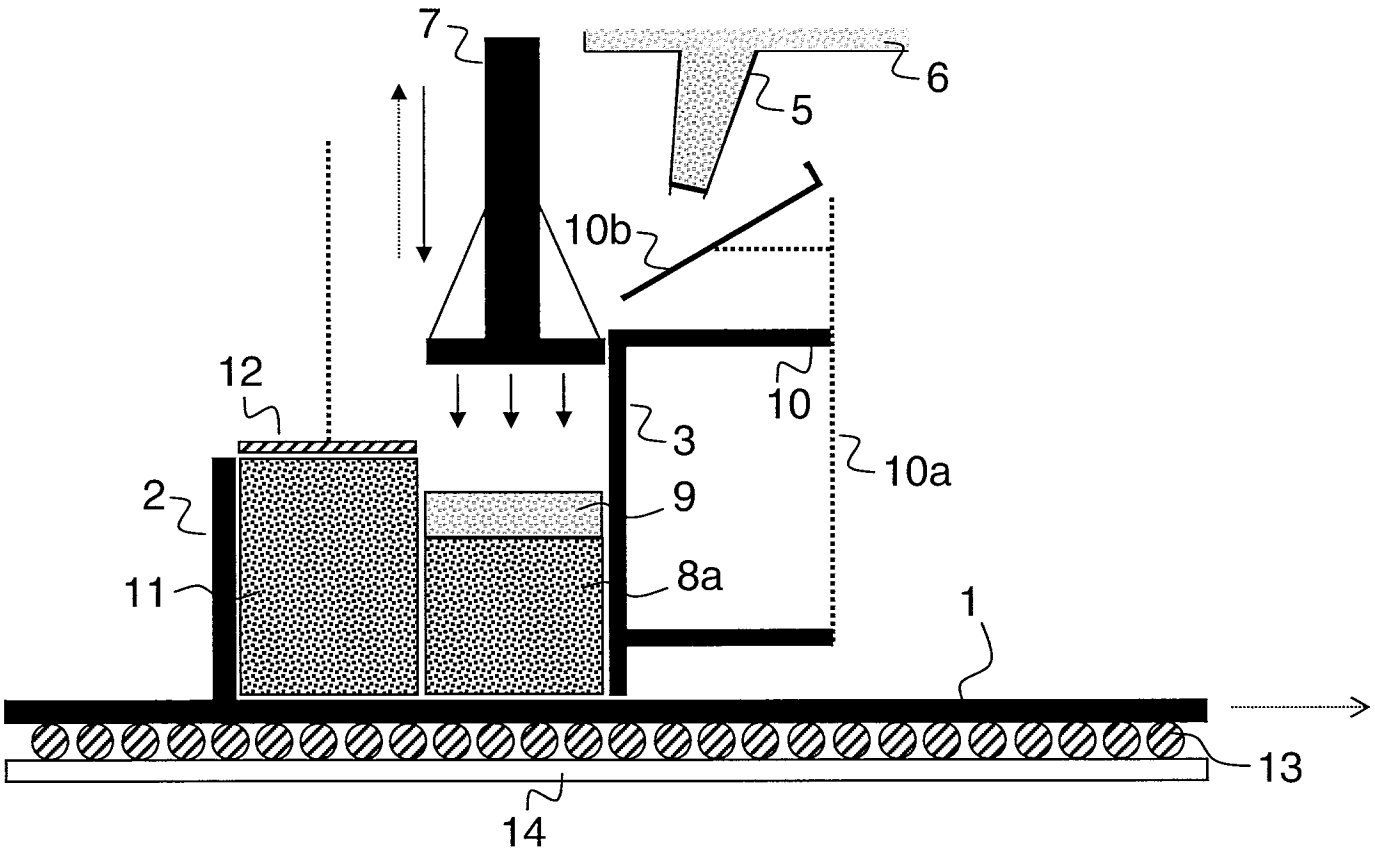

FIG. 2 shows the inventive plate (1) with an arrest wall (2) fastened on it, behind of which an already finish-compacted coal pressing block (11) is arranged. As compared with the drawing in FIG. 1, the plate (1) has been moved on so that the arrest wall (2) mounted on the plate (1) moves away from the stationary closure wall (3). Upstream to the stationary closure wall (3) on the plate, there is a fresh coal pressing block (8*a*) onto which further coal (6) is fed which is then compacted by means of a stamping device (7) with further coal (6) to obtain another second compacted coal pressing block (8*a*). To be seen here is the loose coal layer (9) still lying on the second compacted coal pressing block (8*a*). The finished coal pressing block is covered with a pressed cake cover (12). The plate (1) is equipped with rollers (13) which are mounted on a car (14) that can be moved vertically to the plane of the drawing paper. The plate (1) can for example be moved in the direction of the arrow into a coke oven chamber (1) to charge it.

Figure 3:
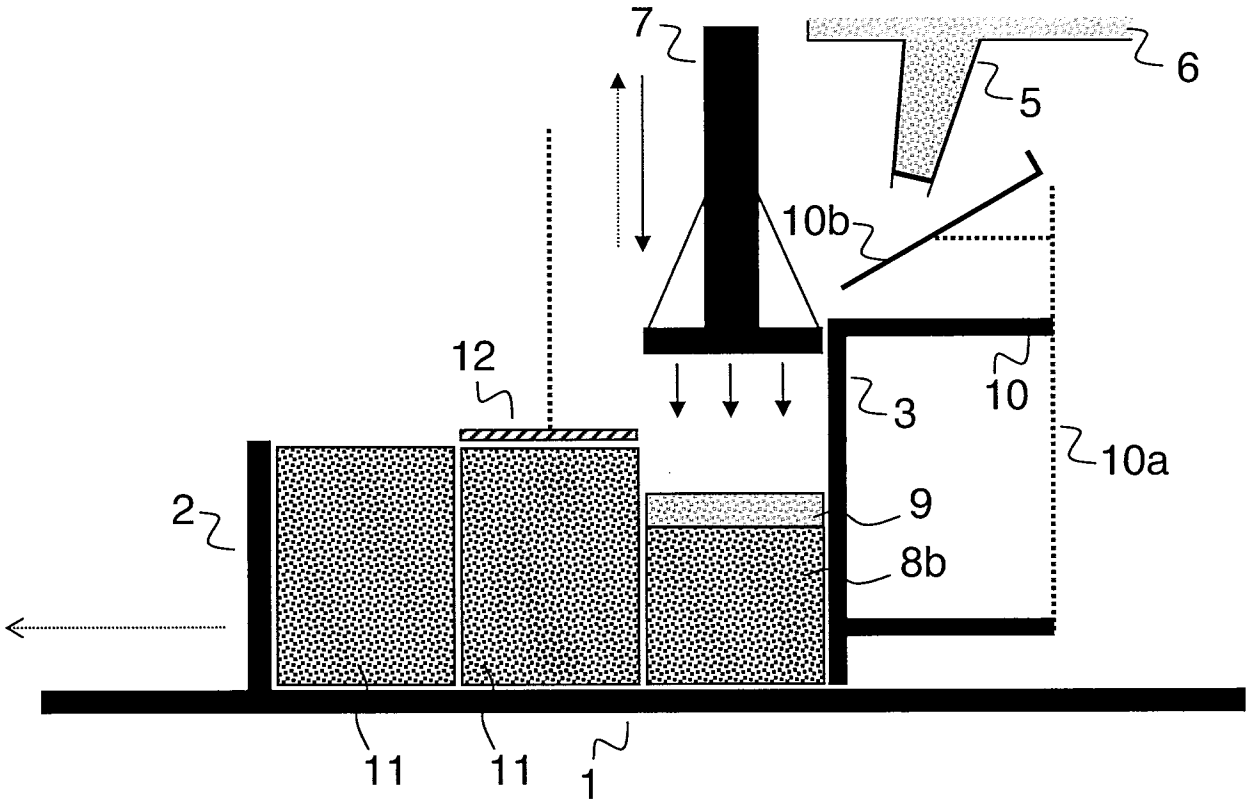

FIG. 3 shows the inventive plate (1) with an arrest wall (2) fastened on it, behind of which another already finish-compacted coal pressing block (11*a*) is arranged. As compared with the drawing in FIG. 1, the plate (2) has been moved on so that the arrest wall (2) mounted on the plate (1) moves away from the stationary closure wall (3). To be seen here is the loose coal layer (9) still lying on the third compacted coal pressing block (8*b*).

Figure 4:
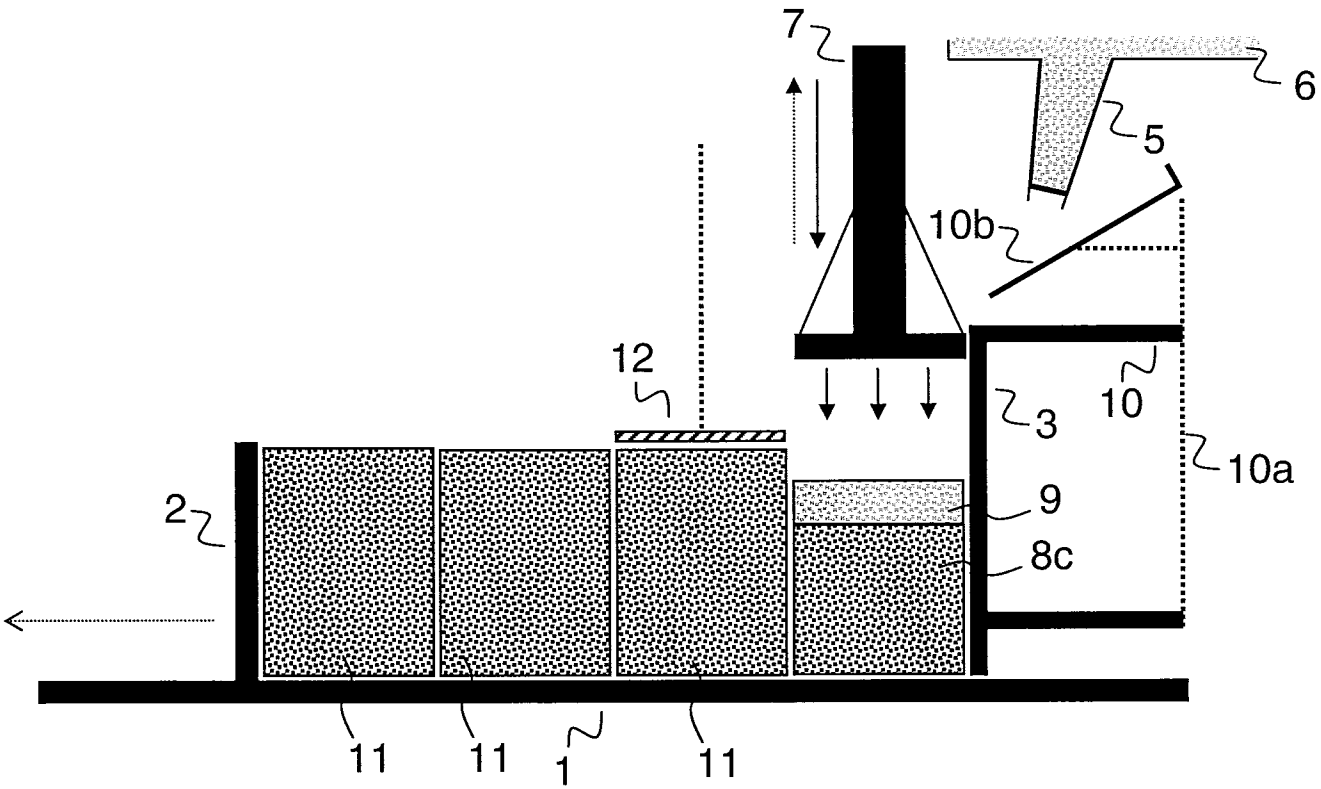

FIG. 4 shows the inventive plate (1) with an arrest wall (2) fastened on it, behind of which another already finish-compacted coal pressing block (11*a*) is arranged. As compared with the drawing in FIG. 1, the plate (3) has been moved on so that the arrest wall (2) mounted on the plate (1) moves away from the stationary closure wall (3). To be seen here is the loose coal layer (9) still lying on the fourth compacted coal pressing block (8*c*).

Figure 5:
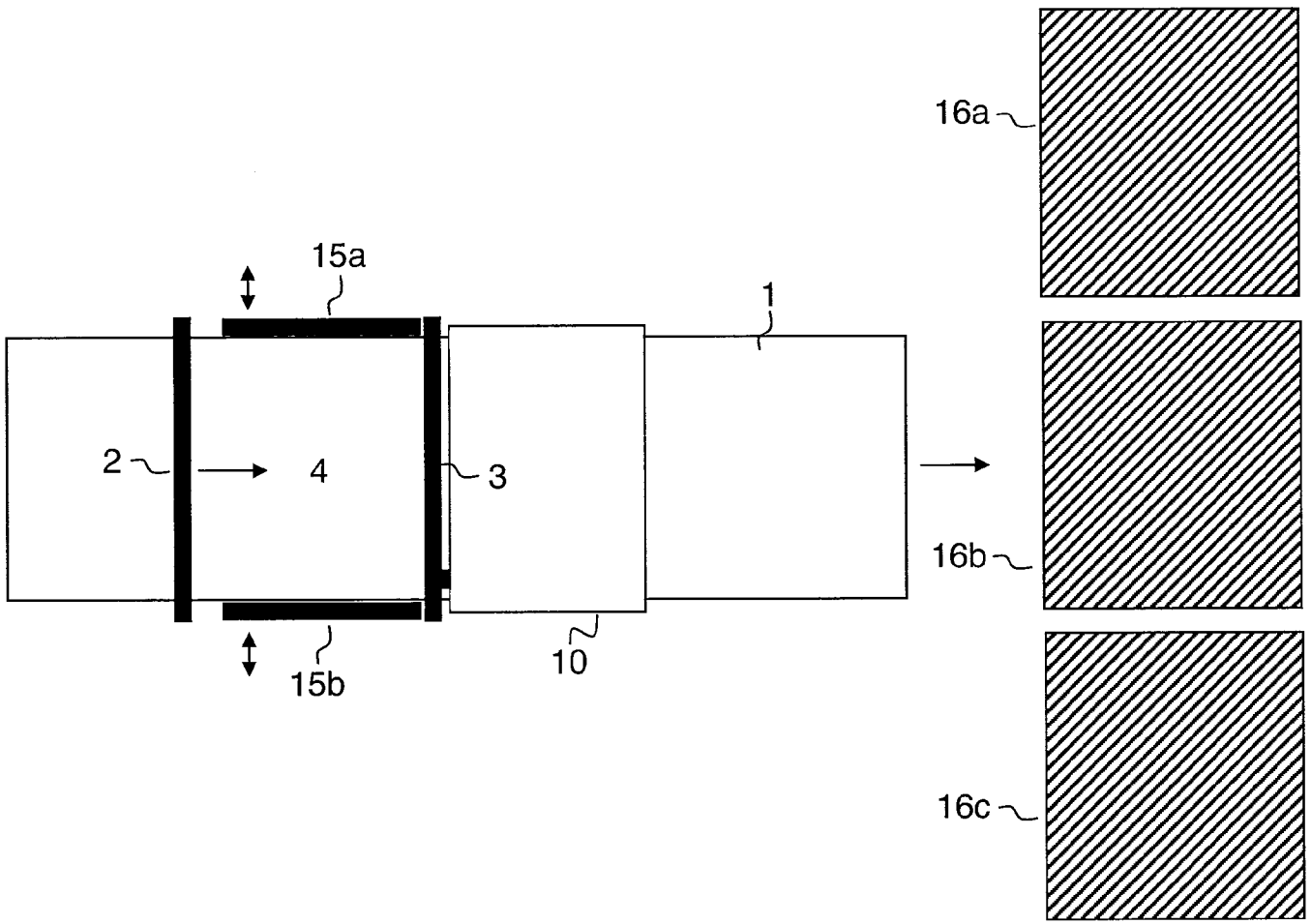

FIG. 5 shows the inventive plate (1) in a vertical view from the top, including the arrest wall (2) which for example can be folded back and which is fastened on it. The coal press mould (4) is formed by this arrest wall (2) as well as by another two lateral stationary walls (15*a*, 15*b*) which can be moved in horizontal direction towards the plate (1) or which can be moved away from it, as well as another stationary closure wall (3) which is not mounted on the plate (1). To be seen here, too, is the cover plate (10) behind the stationary closure wall (3). Upon the pressing cycle, the finished coal pressing blocks can be moved into one (16*b*) of the coke oven chambers (16*a-c*).

LIST OF REFERENCE NUMBERS

1 Plate
2 Arrest wall mounted on the plate
3 Stationary closure wall
4 Press mould
5 Coal feeder device
6 Pourable bulk coal
7 Stamping device
8 Coal pressing block
8*a* Second compacted coal pressing block
8*b* Third compacted coal pressing block
8*c* Fourth compacted coal pressing block
9 Loose coal layer
10 Cover plate
10*a* Holding device
10*b* Feeder chute plate
11 Already finish-compacted coal pressing block
11*a* Other already finish-compacted coal pressing blocks
12 Pressed cake cover
13 Rollers
14 Car
15*a*,15*b* Lateral wall
16*a-c* Coke oven chambers

The invention claimed is:

1. A method for the successive production of coal pressing blocks suitable for coke oven chambers, wherein the coal is poured from a coal feeder device into a press mould comprised of a movable plate equipped with a back-foldable arrest wall impermeable to coal, and comprised of two walls extending in parallel to the direction of movement of the plate and being stationary in one horizontal direction, said walls being movable perpendicular to the direction of movement of the plate in the other horizontal direction into the desired position so that the press mould is permeable to coal only in one horizontal direction, and wherein the side of the press mould which is permeable to coal is closed by a stationary closure wall during the production of coal pressing blocks and moved towards the plate so that the coal is retained by the press mould in the horizontal shape so as to obtain a coal pressing block on pressing, and wherein the plate is moved horizontally in the longitudinal direction of the press mould upon completion of a coal pressing block, and wherein the plate can continue to be transversely displaceable in horizontal direction, wherein for the pressing procedure the plate is braked or arrested in horizontal direction or moved against the stationary closure wall, and the coal is compacted by a stamping device pressed by a device with a vertically acting force onto the coal in the press mould, with the coal being retained by the press mould in the horizontal shape so as to obtain a coal pressing block, and the space in the press mould exposed in horizontal direction as the plate is moved on is utilized for the production of the next coal pressing block.

2. The method for the successive production of coal pressing blocks suitable for coke oven chambers according to claim 1, wherein the produced coal pressing block(s) is (are) covered during the production of the next coal pressing block by a pressed cake cover arranged above the coal pressing block.

3. The method for the successive production of coal pressing blocks suitable for coke oven chambers according to claim 1, wherein the arrest wall is removed or folded back, and that the plate is moved close to the opened coke oven chamber, and that the coal cake composed of finished coal pressing blocks is shifted for charging the coke oven chamber by the car into the coke oven chamber.

4. The method for the successive production of coal pressing blocks suitable for coke oven chambers according to claim 3, wherein the plate is supported on rollers so that the plate is horizontally movable in one direction, and that the rollers are supported on a car which is movable in the second horizontal direction so that the car is moved to the front of the coke oven chamber destined for being charged, and the plate is moved to the front of the coke oven chamber destined for being charged, and that the plate for charging is moved into the coke oven chamber and retracted from the coke oven chamber after charging whilst holding the coal cake front tight.

5. The method for the successive production of coal pressing blocks suitable for coke oven chambers according to claim 1, wherein a coal pressing block has an average width of 3500 mm to 4000 mm and an average length of 450 mm to 550 mm.

6. The method for the successive production of coal pressing blocks suitable for coke oven chambers according to claim 5, wherein a coal pressing block has an average width of 3,750 mm and an average length of 500 mm.

7. The method for the successive production of coal pressing blocks suitable for coke oven chambers according to claim 6, wherein upon completion of production the coal pressing blocks have a height of 950 to 1,050 mm.

8. The method for the successive production of coal pressing blocks suitable for coke oven chambers according to claim 7, wherein upon completion of production the coal pressing block(s) has (have) a height of 1,000 mm.

9. A device for the successive production of coal pressing blocks suitable for coke oven chambers, said device being comprised of one horizontally supported plate movable in one direction, two stationary coal-impermeable closure walls extending in parallel to the horizontal direction of movement of the plate and vertically movable to the direction of movement of the plate, one coal-impermeable closing and back-foldable arrest wall mounted on the plate and arranged transversely to the direction of movement of the plate so that the plate with the two lateral walls and the arrest wall form a press mould which is impermeable to coal in three horizontal directions, and wherein a coal feeder device is arranged above the press mould through which the plate acting as press mould can be filled with pourable bulk coal, and wherein the plate can also be horizontally movable via suitable devices transversely to the direction of movement, wherein the plate with the coal-permeable side of the press mould can be moved with a device against a stationary coal-impermeable closure wall or can be braked in front of the stationary closure wall in a position destined for a pressing cycle, and wherein a stationary stamping device is arranged above the plate, said stamping device being movable in vertical direction and equipped with appropriate lifting mechanisms and exerting a pressing weight load onto the coal lying beneath when falling onto the coal.

10. The device for the successive production of coal pressing blocks suitable for coke oven chambers according to claim 9, wherein the plate is supported on rollers to allow for uni-dimensional horizontal mobility, the said rollers being mounted on a horizontally moveable car which can be moved horizontally along the front of the coke oven battery.

11. The device for the successive production of coal pressing blocks suitable for coke oven chambers according to claim 9, wherein the stamping device which can be moved in vertical direction is driven by a hydraulic device.

12. The device for the successive production of coal pressing blocks suitable for coke oven chambers according to claim 9, wherein the coal feeder device is a reciprocating plate feeder that can be supplied with pourable bulk coal taken from a coal reservoir bin.

13. The device for the successive production of coal pressing blocks suitable for coke oven chambers of claim 10, wherein the horizontally movable car is moved on wheels.

14. The device for the successive production of coal pressing blocks suitable for coke oven chambers according to claim 10, wherein the horizontally movable car is moved on skids or rail.

* * * * *